US010870969B2

(12) United States Patent
Fukuda

(10) Patent No.: US 10,870,969 B2
(45) Date of Patent: Dec. 22, 2020

(54) HYDRAULIC SYSTEM FOR WORKING MACHINE

(71) Applicant: KUBOTA CORPORATION, Osaka (JP)

(72) Inventor: Yuji Fukuda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 203 days.

(21) Appl. No.: 16/158,651

(22) Filed: Oct. 12, 2018

(65) Prior Publication Data

US 2019/0112789 A1 Apr. 18, 2019

(30) Foreign Application Priority Data

Oct. 16, 2017 (JP) ..... 2017-200559

(51) Int. Cl.

| | |
|---|---|
| ***E02F 9/22*** | (2006.01) |
| ***F04B 49/06*** | (2006.01) |
| ***F04B 49/08*** | (2006.01) |
| ***F04B 49/22*** | (2006.01) |
| ***E02F 3/34*** | (2006.01) |

(52) U.S. Cl.

CPC ..... *E02F 9/2246* (2013.01); *E02F 3/3414* (2013.01); *F04B 49/06* (2013.01); *F04B 49/08* (2013.01); *F04B 49/22* (2013.01); *E02F 9/2221* (2013.01); *F04B 2205/09* (2013.01); *F15B 2211/20515* (2013.01); *F15B 2211/20523* (2013.01); *F15B 2211/255* (2013.01); *F15B 2211/3056* (2013.01); *F15B 2211/30525* (2013.01); *F15B 2211/6316* (2013.01); *F15B 2211/6651* (2013.01); *F15B 2211/70* (2013.01)

(58) Field of Classification Search

CPC ..... F15B 11/162; F15B 11/166; F15B 11/17; F15B 21/02; F15B 21/082; F15B 2211/355; F15B 2211/575; E02F 9/22; E02F 9/2235; E02F 9/2242; E02F 9/2285

See application file for complete search history.

(56) References Cited

U.S. PATENT DOCUMENTS

| | | | | |
|---|---|---|---|---|
| 5,784,883 | A * | 7/1998 | Ohkura | B60W 10/06 60/327 |
| 7,904,225 | B2 * | 3/2011 | Takeda | B25D 9/145 340/438 |
| 9,328,757 | B2 * | 5/2016 | Horii | F15B 15/00 |
| 10,316,493 | B2 * | 6/2019 | Fukuda | F16H 61/4008 |
| 10,676,899 | B2 * | 6/2020 | Kim | E02F 9/2004 |

(Continued)

FOREIGN PATENT DOCUMENTS

| | | | |
|---|---|---|---|
| JP | 11100869 | A * | 4/1999 |
| JP | 2013-57366 | | 3/2013 |

*Primary Examiner* — Michael Leslie

(74) *Attorney, Agent, or Firm* — Greenblum & Bernstein, P.L.C.

(57) ABSTRACT

A hydraulic system for a working machine, includes a first hydraulic pump to output an operation fluid, a hydraulic device to be operated by the operation fluid, an operation member to be operated, a control valve to control the hydraulic device based on an operation extent of the operation member, a holding member to set a held operation extent that is the operation extent held in the operation of the operation member, and a pedal to be operated to change the held operation extent set by the holding member.

11 Claims, 7 Drawing Sheets

(56) References Cited

U.S. PATENT DOCUMENTS

| | | | | |
|---|---|---|---|---|
| 2004/0045289 | A1* | 3/2004 | Ikeda | E02F 3/384 60/469 |
| 2012/0291427 | A1* | 11/2012 | Azuma | E02F 9/2292 60/420 |
| 2019/0309499 | A1* | 10/2019 | Horii | F16H 61/42 |

* cited by examiner

HYDRAULIC SYSTEM FOR WORKING MACHINE

CROSS-REFERENCE TO RELATED APPLICATIONS

The present application claims priority under 35 U.S.C. § 119 to Japanese Patent Application No. 2017-200559, filed Oct. 16, 2017. The content of this application is incorporated herein by reference in their entirety.

BACKGROUND OF THE INVENTION

Field of the Invention

The present invention relates to a hydraulic system for a working machine.

Description of Related Art

A working machine disclosed in Japanese Unexamined Patent Publication No. 2013-57366 is previously known.

The working machine disclosed in Japanese Unexamined Patent Publication No. 2013-57366 includes a traveling lever swingably supported, an operation valve configured to change a pressure of the pilot fluid in accordance with an operation extent of the traveling lever, and a traveling motor configured to change a traveling speed of the working machine in accordance with the pressure of the pilot fluid.

SUMMARY OF THE INVENTION

A hydraulic system for a working machine, includes a first hydraulic pump to output an operation fluid, a hydraulic device to be operated by the operation fluid, an operation member to be operated, a control valve to control the hydraulic device based on an operation extent of the operation member, a holding member to set a held operation extent that is the operation extent held in the operation of the operation member, and a pedal to be operated to change the held operation extent set by the holding member.

A hydraulic system for a working machine, includes a first hydraulic pump to output an operation fluid, a hydraulic device to be operated by the operation fluid, an operation member to be operated, a control valve to control the hydraulic device based on an operation extent of the operation member, a holding member to set a held operation extent that is another operation extent preliminarily set other than the operation extent of the operation member, and a pedal to be operated to change the held operation extent set by the holding member.

A hydraulic system for a working machine includes a first hydraulic pump to output an operation fluid, a hydraulic device to be operated by the operation fluid, an operation member to be operated, a pedal to be operated, the pedal being other than the operation member, a control valve to control the hydraulic device based on an operation extent of the operation member, a holding member to set a held operation extent that is the operation extent held in the operation of the operation member, and a control device to change the held operation extent based on operation of the pedal, the held operation extent being set by the holding member.

A hydraulic system for a working machine includes a first hydraulic pump to output an operation fluid, a hydraulic device to be operated by the operation fluid, an operation member to be operated, a pedal to be operated, the pedal being other than the operation member, a control valve to control the hydraulic device based on an operation extent of the operation member, a holding member to set a held operation extent that is another operation extent preliminarily set other than the operation extent of the operation member, and a control device to change the held operation extent based on operation of the pedal, the held operation extent being set by the holding member.

A hydraulic system for a working machine includes a first hydraulic pump to output an operation fluid, a second hydraulic pump to output the operation fluid, the second hydraulic pump being other than the first hydraulic pump, a hydraulic device to be operated by the operation fluid, a first fluid tube connecting the hydraulic device to a control valve, a second fluid tube connected to the second hydraulic pump and connected to the first fluid tube, a switching valve arranged in the second fluid tube, the switching valve having a first position and a second position, the first position blocking the operation fluid from flowing in the second fluid tube, the second position allowing the operation fluid to flow in the second fluid tube, a switching member to switch the switching valve between the first position and the second position, and a pedal to switch the switching valve from the second position to the first position from a state in which the switching valve is held at the second position by operation of the switching valve.

A hydraulic system for a working machine includes a first hydraulic pump to output an operation fluid, a second hydraulic pump to output the operation fluid, the second hydraulic pump being other than the first hydraulic pump, a hydraulic device to be operated by the operation fluid, a first fluid tube connecting the hydraulic device to a control valve, a second fluid tube connected to the second hydraulic pump and connected to the first fluid tube, a switching valve arranged in the second fluid tube, the switching valve having a first position and a second position, the first position blocking the operation fluid from flowing in the second fluid tube, the second position allowing the operation fluid to flow in the second fluid tube, a switching member to switch the switching valve between the first position and the second position, and a pedal to be operated. The control device switches the switching valve from the second position to the first position when the pedal is operated under a state in which the switching valve is held at the second position by operation of the switching valve.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
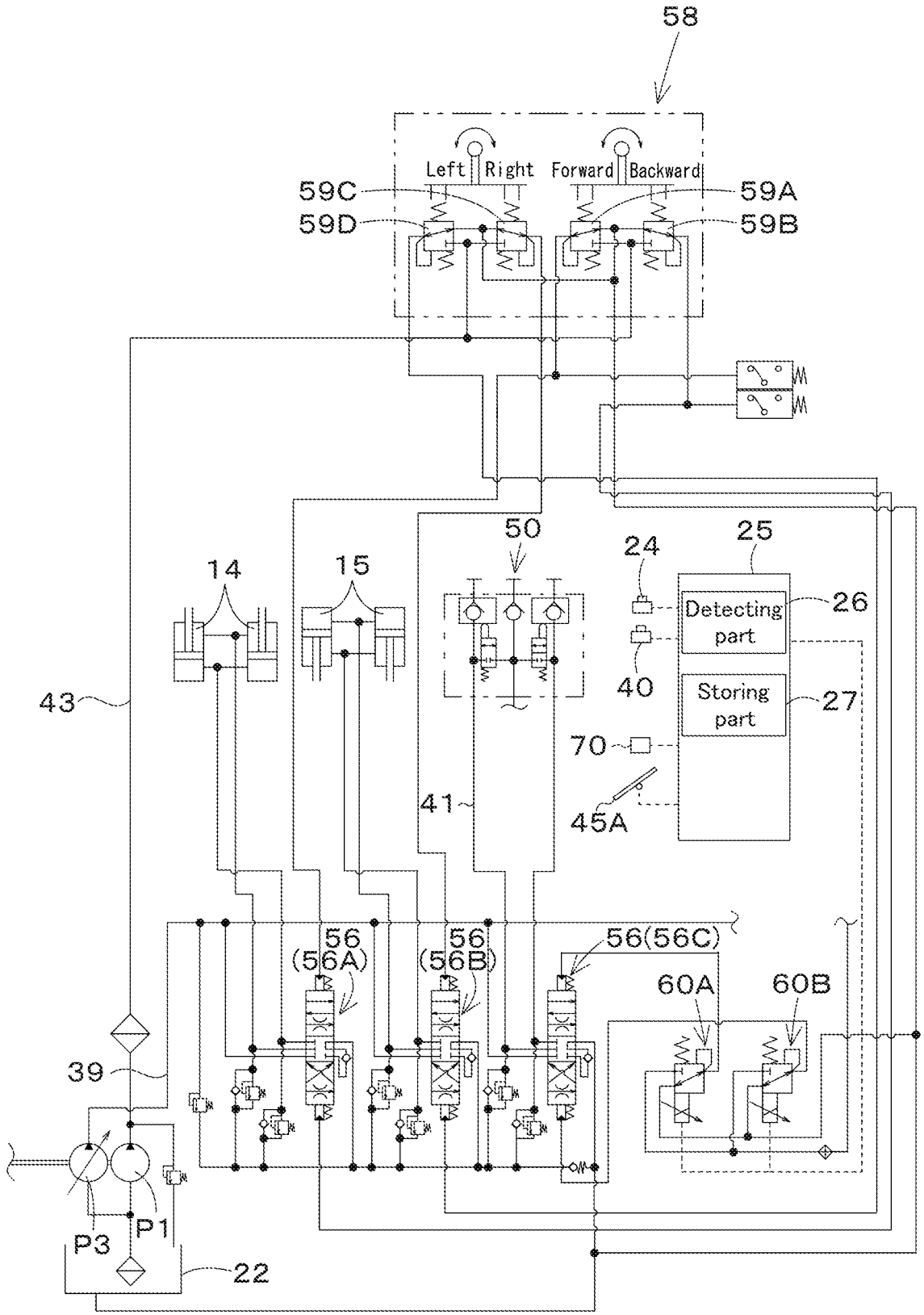
FIG. 1 is an overall view of a hydraulic system according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

Hereinafter, embodiments of a hydraulic system of a working machine 1 according to the present invention and of the working machine 1 having the hydraulic system according to the present invention will be described with reference to the drawings as appropriate.

First Embodiment

Figure 6:
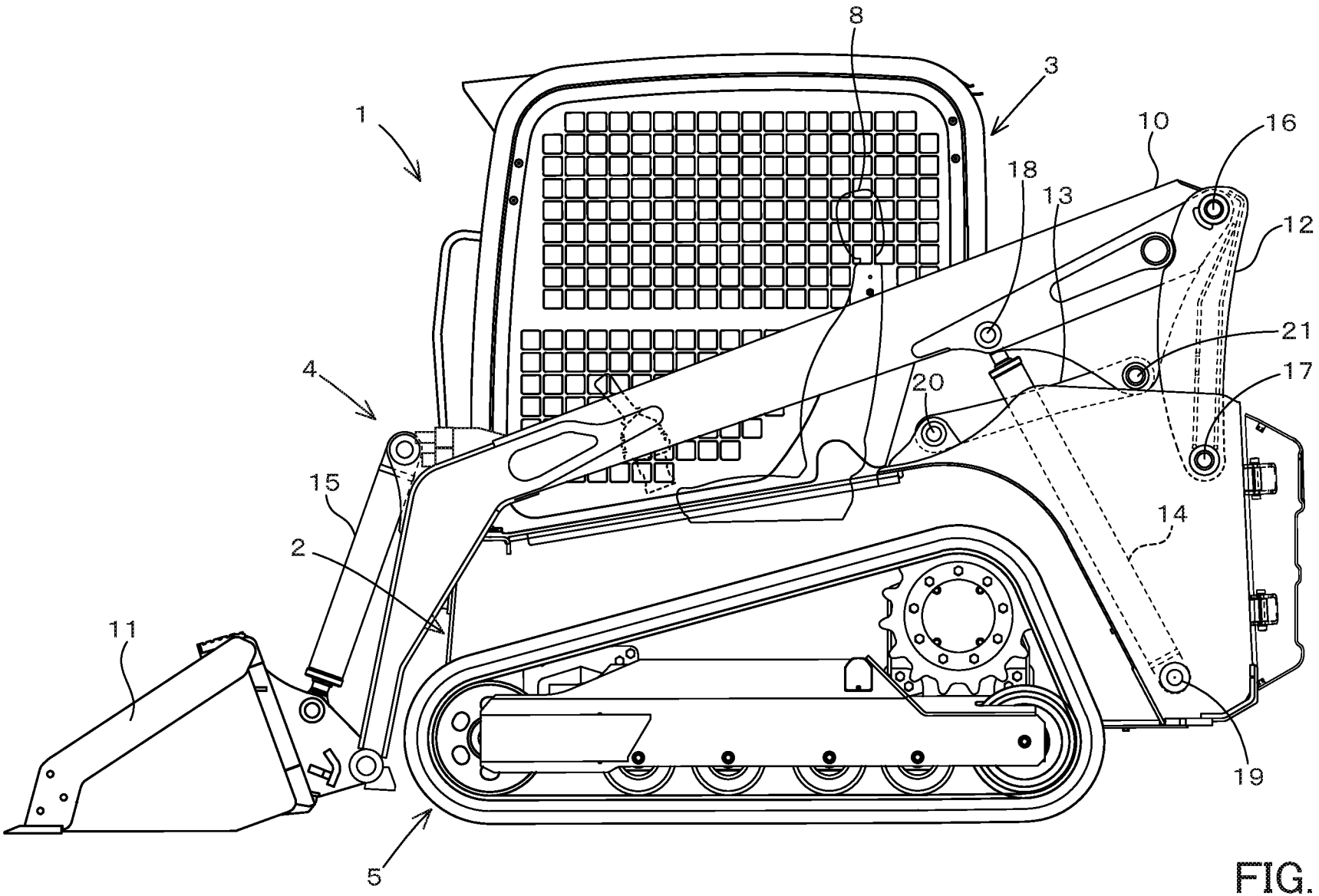
FIG. 6 is a view illustrating a side surface of a track loader as an example of a working machine according to the embodiments of the present invention.
Figure 7:
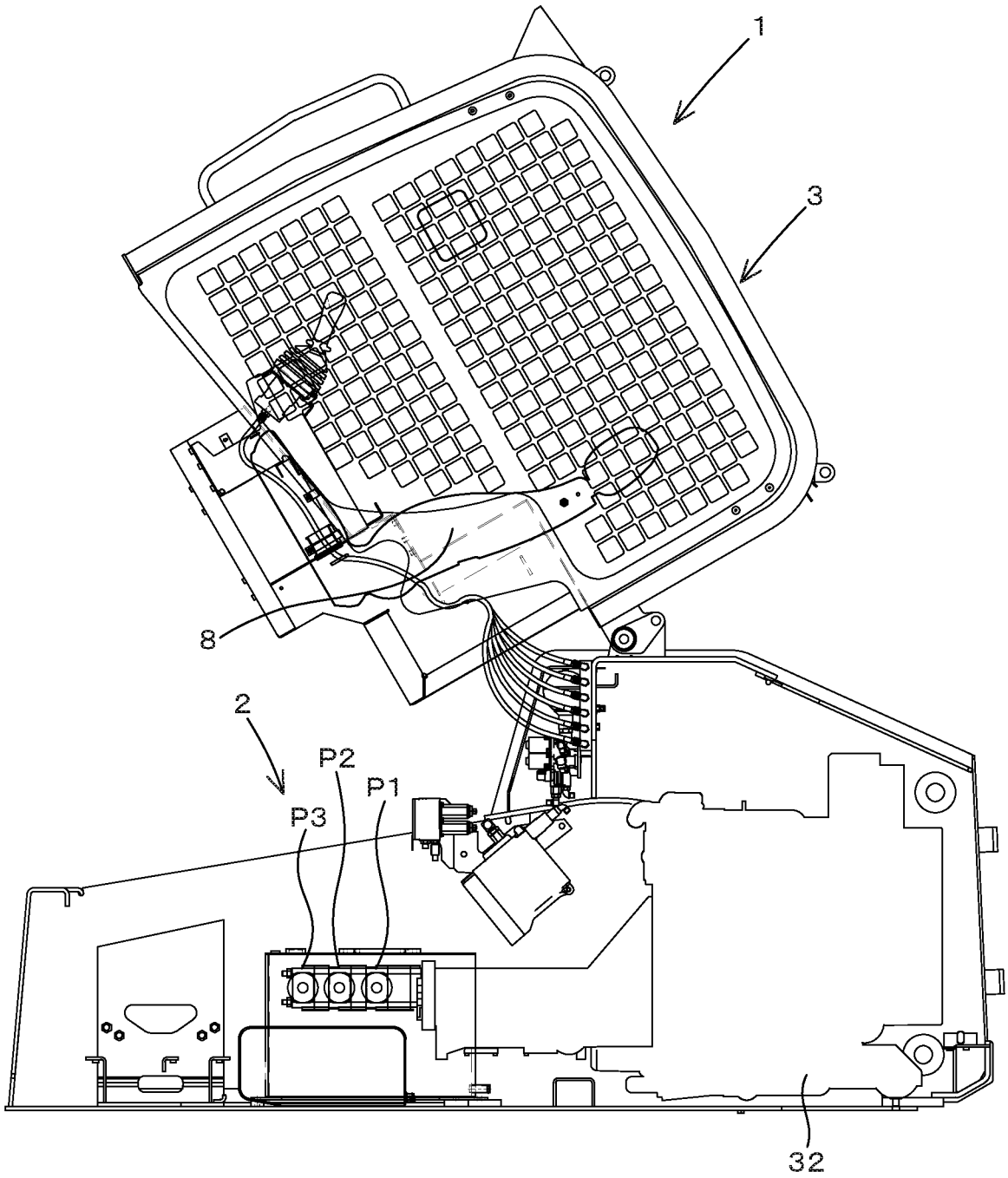
FIG. 7 is a side view illustrating a part of the track loader lifting up a cabin according to the embodiments.

First, an overall configuration of the working machine 1 will be described below. As shown in FIG. 6 and FIG. 7, the working machine 1 includes a machine body 2, a cabin 3, a working device 4, and a traveling device 5. Although FIG. 6 and FIG. 7 show a compact track loader as an example of the working machine 1, the working machine 1 according to the embodiments of the present invention is not limited to the compact track loader, but may be a tractor, a skid steer loader, a backhoe, or the like.

In the explanations according to the embodiments of the present invention, the front side (the left side in FIG. 6) of an operator seated on the operator seat 8 of the working machine 1 is referred to as the front. The rear side (the right side in FIG. 6) of the operator is referred to as the rear. The left side (the front surface side of FIG. 6) of the operator is referred to as the left. The right side (the back surface side of FIG. 6) of the operator is referred to as the right.

The cabin 3 is mounted on the machine body 2. The cabin 3 is provided with the operator seat 8. The working device 4 is attached to the machine body 2. The traveling device 5 is provided outside the machine body 2. A prime mover 32 is mounted on a rear portion of the body 2.

The working device 4 has a boom 10, a working tool 11, a lift link 12, a control link 13, a boom cylinder 14, and a bucket cylinder 15.

The boom 10 is provided on the right side of the cabin 3 so as to be freely swung upward and downward. Another boom 10 is provided on the left side of the cabin 3 so as to be freely swung upward and downward. The working tool 11 is, for example, a bucket, and the bucket 11 is provided at a tip end portion (a front end portion) of the boom 10 so as to be freely swung upward and downward. The lift link 12 and the control link 13 support a base portion (a rear portion) of the boom 10 so that the boom 10 is freely swung upward and downward. The boom cylinder 14 is stretched and shortened to move the boom 10 upward and downward. The bucket cylinder 15 is stretched and shortened to swing the bucket 11.

The front portion of the boom 10 arranged on the left is coupled to the front portion of the boom 10 arranged on the right by a deformed coupling pipe. The base portions (the rear portions) of the booms 10 are coupled to each other by a circular coupling pipe.

The lift link 12, the control link 13, and the boom cylinder 14 are provided on the left side of the machine body 2, corresponding to the boom 10 arranged on the left. Another lift link 12, another control link 13, and another boom cylinder 14 are provided on the right side of the machine body 2, corresponding to the boom 10 arranged on the right.

The lift link 12 is vertically installed at the rear portion of the base portion of the boom 10. An upper portion (one end side) of the lift link 12 is pivotally supported on the base portion of the boom 10 by a pivot shaft (a first pivot shaft) 16 so as to be close to the rear portion of the base portion and rotatable around a lateral axis.

In addition, the lower portion (the other end side) of the lift link 12 is pivotally supported on the machine body 2 by a pivot shaft (a second pivot shaft) 17 so as to be close to a rear portion of the machine body 2 and rotatable around the lateral axis. The second pivot shaft 17 is provided below the first pivot shaft 16.

The upper portion of the boom cylinder 14 is pivotally supported by a pivot shaft (a third pivot shaft) 18 so as to be rotatable around the lateral axis. The third pivot shaft 18 is provided at the base portion of the boom 10, that is, at the front portion of the base portion. The lower portion of the boom cylinder 14 is pivotally supported by a pivot shaft (a fourth pivot shaft) 19 so as to be rotatable around the lateral axis. The fourth pivot shaft 19 is provided at the rear portion of the machine body 2 and below the third pivot shaft 18 so as to be close to a lower portion of the rear portion of the machine body 2.

The control link 13 is provided in front of the lift link 12. One end of the control link 13 is pivotally supported by a pivot shaft (a fifth pivot shaft) 20 so as to be rotatable around the lateral axis. The fifth pivot shaft 20 is provided on the machine body 2, that is, on a position corresponding to the front of the lift link 12.

The other end of the control link 13 is pivotally supported by a pivot shaft (a sixth pivot shaft) 21 around the lateral axis. The sixth pivot shaft 21 is provided on the boom 10, that is, in front of the second pivot shaft 17 and above the second pivot shaft 17.

When the boom cylinder 14 is stretched and shortened, the boom 10 is swung upward and downward around the first pivot shaft 16 while the base portion of the boom 10 is supported by the lift link 12 and the control link 13, and the tip end portion of the boom 10 is moved upward and downward.

The control link 13 is swung upward and downward about the fifth pivot shaft 20 in synchronization with the boom 10 swinging upward and downward. The lift link 12 is swung forward and backward about the second pivot shaft 17 in synchronization with the control link 13 swinging upward and downward.

In place of the bucket 11, another working tool 11 can be attached to the front portion of the boom 10. As the other working tool 11, an attachment (an auxiliary attachment) 50 such as a hydraulic crusher, a hydraulic breaker, an angle bloom, an earth auger, a pallet fork, a sweeper, a mower, a snow blower, or the like is, for example, exemplified.

On the front portion of the boom 10 arranged on the left, a hydraulic taking portion is provided. The hydraulic taking portion is a device configured to connect the hydraulic actuator provided to the auxiliary attachment 50 to the piping such as a hydraulic pipe provided to the boom 10.

The hydraulic taking portion is connected to the hydraulic actuator of the auxiliary attachment 50 by another hydraulic pipe. The operation fluid supplied to the hydraulic taking portion passes through the hydraulic pipe and is supplied to the hydraulic actuator.

The bucket cylinder 15 is arranged on the boom 10 so as to be close to the front portion of the boom 10. When the bucket cylinder 15 is stretched and shortened, the bucket 11 is swung. A hydraulic actuator to be operated by the operation fluid such as the boom 10, the bucket 11, or the auxiliary attachment 50 is called a hydraulic device.

In the embodiment, the hydraulic device is a hydraulic actuator of the auxiliary attachment 50.

The machine body 2 is provided with the prime mover 32. The prime mover 32 is constituted of an electric motor configured to be driven by electric power or of an engine (a diesel engine, a gasoline engine) that is an internal combustion engine configured to be driven by petroleum-based fuel. In the embodiment, the prime mover 32 is constituted of the engine.

In the present embodiment, the traveling device 5 arranged on the left is constituted of a crawler type (including a semi-crawler type) traveling device, and the traveling device 5 arranged on the right is also constituted of the crawler type (including the semi-crawler type) traveling device. Note that the traveling device 5 may employ a wheel type traveling device that has a front wheel and a rear wheel.

Next, a hydraulic system of the working machine 1 according to the embodiments of the present invention will be described below.

FIG. 1 shows an overall view of the hydraulic system for the working system provided in the working machine 1.

As shown in FIG. 1, the hydraulic system for the working system includes a first hydraulic pump P1 and a third hydraulic pump P3. The first hydraulic pump P1 is a pump configured to be driven by the motive power of the prime mover 32, and is constituted of a constant displacement type gear pump.

The first hydraulic pump P1 is configured to output the operation fluid stored in the operation fluid tank 22. In particular, the first hydraulic pump P1 outputs the operation fluid mainly used for the control. For convenience of the explanation, the operation fluid outputted from the first hydraulic pump P1 is referred to as pilot fluid, and a pressure of the pilot fluid is referred to as a pilot pressure.

The third hydraulic pump P3 is a pump configured to be driven by the motive power of the prime mover 32, and is a pump installed at a position different from the position of the first hydraulic pump P1. The third hydraulic pump P3 is constituted of a variable displacement axial pump of a swash plate type.

The third hydraulic pump P3 is configured to output the operation fluid stored in the operation fluid tank 22. In particular, the third hydraulic pump P3 outputs the operation fluid mainly used for activating the hydraulic actuator.

In addition, the hydraulic system for the working system is a system configured to operate the boom 10, the bucket 11, the hydraulic actuator of the spare attachment 50, and the like, and is provided with a plurality of control valves 56. The plurality of control valves 56 are provided in a fluid tube 39 connected to an outputting side of the third hydraulic pump P3. The plurality of control valves 56 include a boom control valve 56A, a bucket control valve 56B, and an auxiliary control valve 56C.

The boom control valve 56A is a valve configured to control the boom cylinder 14. The bucket control valve 56B is a valve configured to control the bucket cylinder 15. And, the auxiliary control valve 56C is a valve configured to control the hydraulic actuator of the auxiliary attachment 50.

Describing in detail the auxiliary control valve 56C, the auxiliary control valve 56C is constituted of a direct-acting spool type three-position selector valve to be activated by the pilot pressure. The auxiliary control valve 56C is configured to be switched between a neutral position, a first position different from the neutral position, and a second position different from the neutral position and the first position.

The auxiliary control valve 56C moves a spool with use of the pressure of the pilot fluid to be switched between the neutral position, the first position, and the second position, the pilot fluid being outputted from the first solenoid valve 60A and the second solenoid valve 60B. As shown in FIG. 1, the auxiliary control valve 56C is connected to the hydraulic actuator of the auxiliary attachment 50 by a first fluid tube 41.

The boom 10 and the bucket 11 can be operated by the operation lever 58. The operation lever 58 is provided in the vicinity of the operator seat 8. The operation lever 58 is supported so as to be capable of being tilted from a neutral position in oblique directions between the forward direction, the backward direction, the leftward direction, and the rightward direction.

When the operation lever 58 is tilted in the tilting operation, it is possible to operate the plurality of operation valves 59 (the operation valve 59A, the operation valve 59B, the operation valve 59C, the operation valve 59D) arranged on the lower portion of the operation lever 58. The plurality of operation valves 59 are connected to the output fluid tube 43 connected to the first hydraulic pump P1, and can supply the operation fluid outputted from the first hydraulic pump P1.

When the operation lever 58 is tilted forward (to the front side), the operation valve 59A for downward movement is operated, and thus the pilot pressure is outputted from the operation valve 59A for downward movement. The pilot pressure is applied to the hydraulic receiving portion of the boom control valve 56A, and the boom 10 is moved downward.

When the operation lever 58 is tilted backward (to the rear side), the operation valve 59B for upward movement is operated, and thus the pilot pressure is outputted from the operation valve 59B for upward movement. The pilot pressure is applied to the hydraulic receiving portion of the boom control valve 56A, and the boom 10 is moved upward.

When the operation lever 58 is tilted rightward (to the right side), the operation valve 59C for bucket dumping is operated, and then the pilot fluid is applied to the hydraulic receiving portion of the bucket control valve 56B. As the result, the bucket control valve 56B is operated in a direction to stretch the bucket cylinder 15, and the bucket 11 performs the dumping operation at a speed proportional to the tilting extent of the operation lever 58.

When the operation lever 58 is tilted leftward (to the left side), the operation valve 59D for bucket shoveling is operated, and then the pilot fluid is applied to the hydraulic receiving portion of the bucket control valve 56B. As the result, the bucket control valve 56B is operated in a direction to shorten the bucket cylinder 15, and the bucket 11 performs the shoveling operation at a speed proportional to the tilting extent of the operation lever 58.

The operation of the auxiliary attachment 50 can be performed by the operation member 24 which is an operable switch provided in the vicinity of the operator seat 8. In particular, the operation of the auxiliary attachment 50 is controlled on the basis of the operation extent of the operation member 24.

The operation member 24 is, for example, constituted of a swingable seesaw switch, a slidable slide switch, or a swingable lever. The operation extent of the operation member 24 is detected by the detecting part 26 of the control device 25. The control device 25 is provided in the working machine 1, and is constituted of a CPU or the like. The control device 25 includes a detecting part 26 and a storage part 27.

The detecting part 26 is constituted of a program and the like for detecting the operation extent of the operation member 24. The storage part 27 is constituted of a nonvolatile memory or the like, and stores a held operation extent, a changed operation extent, and the like of the operation member 24, which will be described later.

Now, the control device 25 is configured to be switched between a normal mode and a hold mode. The normal mode is a state in which the control device 25 does not hold the operation extent of the operation member 24, the operation extent having been detected by the detecting part 26. The hold mode is a state in which the control device 25 holds the operation extent of the operation member 24, the operation extent having been detected by the detecting part 26.

A pedal 45A and a holding member 40 provided in the working machine 1 are connected to the control device 25.

The holding member 40 is a member configured to instruct to hold the operation extent of the operation member 24 as a held operation extent, the operation extent having been detected by the detecting part 26. In other words, the holding member 40 sets the held operation extent that is the operation extent at the time of operating the operation member 24.

When the holding member 40 is pressed under a state where the operator operates the operation member 24 from the neutral position to one side or the other side, a signal is outputted to the control device 25, the signal instructing to hold the operation extent of the operation member 24 detected by the detecting part 26.

On the other hand, when the holding member 40 is pressed again, the hold mode is canceled. The holding member 40 is constituted of a push button switch such as a momentary switch or an alternate switch. In other words, the control device 25 is configured to be switched between the hold mode and the normal mode, the hold mode being the state to hold the operation extent of the operation member 24 detected by the detecting part 26, the normal mode being the state not to hold the operation extent of the operation member 24 detected by the detecting part 26.

Note that the holding member 40 is not limited to the push button switch such as the momentary switch and the alternate switch, and may be constituted of any switch configured to output a signal to the control device 25. In addition, the holding member 40 may be a figure such as an icon or the like, the figure being provided in the vicinity of the operator seat 8 and displayed on a display device such as an operable touch panel and the like.

When a signal is inputted from the holding member 40 to the control device 25, the signal instructing to hold the operation extent of the operation member 24 detected by the detecting part 26, the held operation extent detected by the detecting part 26 is stored to the storage part 27 provided in the control device 25.

The pedal 45A changes the held operation extent set by the holding member 40 on the basis of the operation. When the pedal 45A is operated and a signal corresponding to the operation extent of the pedal 45A is input to the control device 25 in the control device 25 under the hold mode, the control device 25 can change the held operation extent on the basis of the operation of the pedal 45A, the held operation extent being set by the holding member 40.

The pedal 45A is an operation pedal of an organ type or a hanging type arranged at the foot of the operator seat 8 of the working machine 1. That is, the pedal 45A is a member to be operated by the foot of the operator seated on the operator seat 8. The pedal 45A is a pedal member different from the accelerator pedal and the brake pedal.

It should be noted that the pedal 45A is not limited to the operation pedal of the organ type or the hanging type, and may be any pedal member to be operated by the foot of the operator. In the following description, the held operation extent changed by the operation of the pedal 45A is referred to as a changed operation extent.

When the control device 25 is in the normal mode, the control device 25 outputs a command corresponding to the operation extent of the operation member 24 detected by the detection portion 26 to the first solenoid valve 60A and the second solenoid valve 60B. The first solenoid valve 60A and the second solenoid valve 60B are opened in accordance with the operation extent of the operation member 24.

As the result, the pilot fluid is supplied to the auxiliary control valve 56C connected to the first solenoid valve 60A and the second solenoid valve 60B, and the hydraulic actuator of the auxiliary attachment 50 is operated by the hydraulic fluid supplied from the auxiliary control valve 56C. That is, the auxiliary control valve 56C is controlled on the basis of the operation extent of the operation member 24.

On the other hand, when the control device 25 is in the hold mode, the control device 25 outputs, on the basis of the held operation extent or the changed operation extent, a command signal to the first solenoid valve 60A and the second solenoid valve 60B in accordance with the operation extent of the operation member 24 or/and the operation extent of the pedal 45A.

Figure 2:
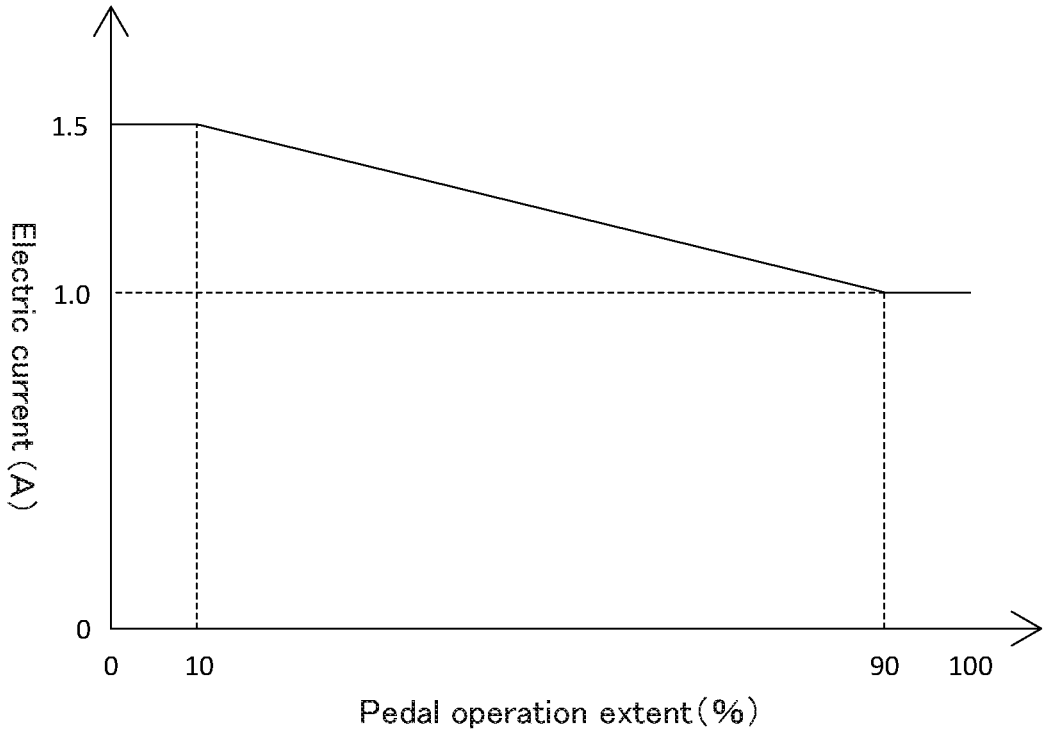
FIG. 2 is a view illustrating an example of a relation between an operation extent of a pedal and an electric current outputted to a first solenoid valve and a second solenoid valve according to the first embodiment.
Figure 3:
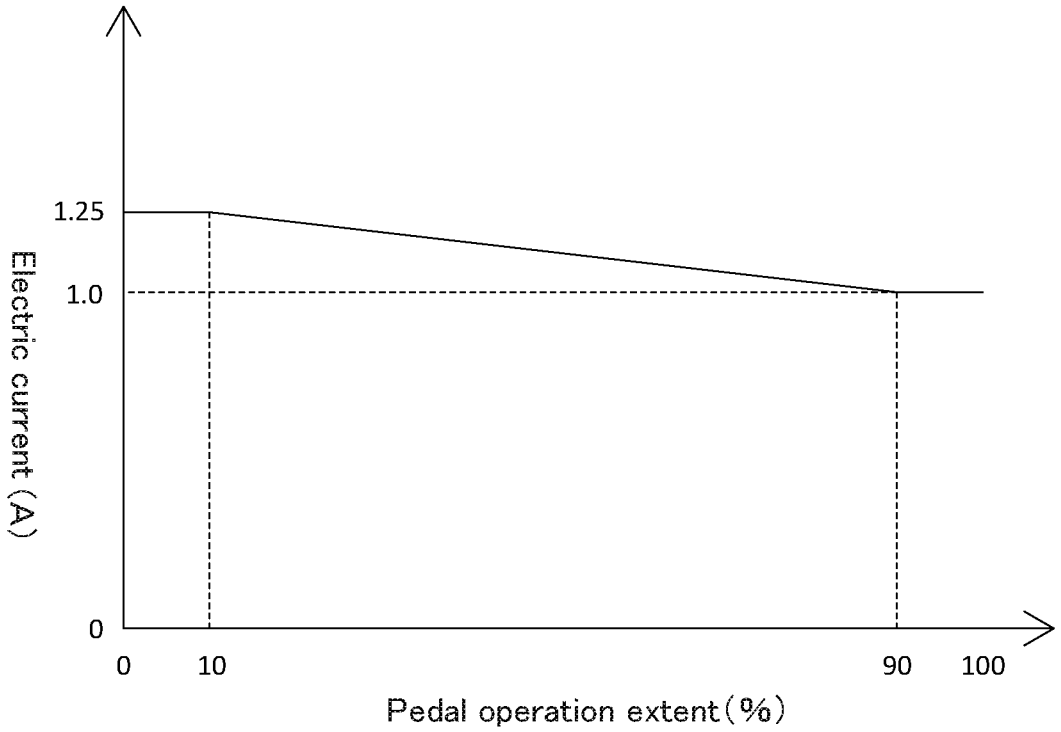
FIG. 3 is a view illustrating another example of the relation between the operation extent of the pedal and the electric current outputted to the first solenoid valve and the second solenoid valve according to the first embodiment.

For example, as shown in FIG. 2 and FIG. 3, on the basis of the held operation extent of the operation member 24 and the operation extent of the pedal 45A each stored in the storage part 27, the control device 25 outputs a command according to the operation extents of the operation member 24 and the pedal 45A with an electric current to the first solenoid valve 60A and the solenoid valve 60B.

To explain the hold mode more specifically, when the pedal 45A is not operated, the control device 25 outputs an electric current (a holding current H) to the first solenoid valve 60A and the second solenoid valve 60B on the basis of the held operation extent of the operation member 24 stored in the storage part 27.

That is, when the operation extent of the pedal 45A is at least 0% in the hold mode, the holding current H that is a constant electric current is outputted from the control device 25.

The holding current H is calculated on the basis of the held operation extent of the operation member 24 stored in the storage part 27. For example, in the case of FIG. 2, the held operation extent of the operation member 24 stored in the storage section 27 is the maximum (100%), and the holding current H is 1.5 A (Ampere). On the other hand, in the case of FIG. 3, the held operation extent of the operation member 24 stored in the storage section 27 is 83%, and the holding current H is 1.25 A (Ampere).

On the other hand, when the pedal 45A is operated, the control device 25 outputs an electric current (a changed current D) to the first solenoid valve 60A and the second solenoid valve 60B on the basis of the held operation extent of the operation member 24 and the operation extent of the pedal 45A each stored in the storage part 27.

In particular, the electric current (the changed current D) to be outputted to the first solenoid valve 60A and the second solenoid valve 60B decreases in proportion to the operation extent of the pedal 45A. To explain the changed current D in detail, the changed current D is, for example, calculated in accordance with "the electric current (A) at the time when the held operation extent of the operation member 24 is the maximum×the changed operation extent (%)/100" in the predetermined range (10 to 90%) described above.

That is, the changed current D is calculated on the basis of the changed operation extent. Here, the changed operation extent is a held operation extent changed on the basis of the pedal operation extent. For example, the changed operation extent is calculated in accordance with "the held operation extent (%)×(the pedal operation extent−10)×a change coefficient".

As shown in FIG. 2 and FIG. 3, a dead zone region may be set to the changed current D as indicated in 0 to 10% of the operation extent of the pedal 45A. When the operation extent of the pedal 45A is in the dead zone region, the control device 25 outputs, as the changed current D, an electric current equivalent to the holding current H.

When the operation extent of the pedal 45A is in a predetermined range (10 to 90%) exceeding the dead zone region, the electric current (the changed current D) to be outputted to the first solenoid valve 60A and the second solenoid valve 60B is reduced in proportion to the operation extent of the pedal 45A. As shown in FIG. 2 and FIG. 3, when the operation extent of the pedal 45A is in the predetermined range (10 to 90%), the changed operation extent decreases in proportion to the operation extent of the pedal 45A.

The changed current D decreases from the holding current H to the minimum electric current M described below in accordance with the operation extent of the pedal 45A. Meanwhile, the change coefficient is a value preliminarily stored in the storage part 27, and a value of the change coefficient can be changed by changing the setting of the control device 25.

When the operation extent of the pedal 45A is 90 to 100%, the control device 25 outputs a constant electric current (the minimum current M) to the first solenoid valve 60A and the second solenoid valve 60B. The minimum current M is a value calculated on the basis of the change coefficient, and is the same value as that of the changed current D provided when the operation extent of the pedal 45A is the maximum (90%) of the predetermined range. For example in FIG. 2, the minimum current M which is the electric current outputted by the control device 25 within the range of 90 to 100% of the operation extent of the pedal 45A is 1.0 A (Ampere).

In addition, for example in FIG. 3, the minimum current M which is the electric current outputted by the control device 25 within the range of 90 to 100% of the operation extent of the pedal 45A is 1.0 A (Ampere). Note that the predetermined range (10 to 90%) of the operation extent mentioned above may be 5 to 95% or any range as long as the control device 25 outputs a constant electric current in the case where the operation pedal 45A is depressed to the maximum.

In addition, the calculation formula of the changed current D and the changed operation extent is provided on the basis of the magnetic excitation, and is not limited to the calculation formula described above, and may be anything as long as the changed current D increases and decreases in accordance with the operation extent of the pedal 45A.

That is, the change coefficient may be a constant coefficient. In that case, regardless of the held operation extent, the proportional coefficient of the changed operation extent with respect to the operation extent of the pedal 45A is a constant value. In the case where the change coefficient is a constant coefficient, for example, the inclinations that are the correlations between the operation extent of the pedal 45A and the electric current are identical in FIG. 2 and FIG. 3.

The first solenoid valve 60A and the second solenoid valve 60B are opened in accordance with the held operation extent of the operation member 24 stored in the storage section 27 and/or the operation extent of the pedal 45A.

As the result, the pilot fluid is supplied to the auxiliary control valve 56C connected to the first solenoid valve 60A and the second solenoid valve 60B, and the hydraulic actuator of the auxiliary attachment 50 is operated by the hydraulic fluid supplied from the auxiliary control valve 56C.

As described above, when the operation extent of the pedal 45A is out of the predetermined range, the control device 25 outputs a constant current to the first solenoid valve 60A and the second solenoid valve 60B. When the operation extent of the pedal 45A is within the predetermined range, the control device 25 outputs an electric current to the first solenoid valve 60A and the second solenoid valve 60B, the electric current being proportional to the operation extent of the pedal 45A.

More specifically, as shown in FIG. 2 and FIG. 3, the control device 25 controls the control valve 56 on the basis of the held operation extent changed by the pedal 45A and thereby reduces the flow rate of the hydraulic fluid supplied to the hydraulic device 50.

In this manner, the working speed of the hydraulic device 50 can be kept constant by operating the holding member 40, and when the pedal 45A is operated by the foot, it is possible to easily and conveniently change the working speed of the hydraulic device 50 without releasing the operation member 24 from hands.

In this manner, the operator can easily interrupt the working of the working machine 1 by operating the pedal 45A. In addition, since the working speed before the interruption can be stored, it is possible to easily return to the working.

In addition, the operator can restrict the working speed of the working machine 1 by operating the pedal 45A different from the operation member 24. In this manner, by operating the pedal 45A with the foot, the operator can easily and temporarily restrict the working speed of the working machine 1 without releasing the operation member 24 from the hand.

In addition, a lamp 70 is provided on the operation lever 58 arranged facing toward the operator side of the operation lever 58 in the vicinity of the operator seat 8, the lamp 70 being a compact light bulb such as an LED (light emitting diode) or wheat bulb. In addition, the installation location of the lamp 70 is not limited to the operation lever 58, and may be anywhere as long as the lamp 70 is arranged at a place easily confirmed by the operator operating the working machine 1. The lamp 70 is connected to the control device 25, and the control device 25 controls the lighting of the lamp 70.

To explain more specifically, in the case where the auxiliary control valve 56C is closed, that is, in the case where the operation fluid is not outputted from the auxiliary control valve 56C, the control device 25 turns off the lamp 70. In other words, In a case where the auxiliary control valve 56C is open, that is, in the case where the operation fluid is outputted from the auxiliary control valve 56C, the control device 25 turns on the lamp 70 in the case where the holding member 40 is pressed and the working machine 1 shifts to be in the hold mode.

Meanwhile, the control device 25 turns off the lamp 70 when the holding member 40 is pressed again, the hold mode is canceled, and the working machine 1 shifts to be in the normal mode. That is, the lamp 70 lights up when the holding member 40 sets the held operation extent.

As the result, when the working machine 1 shifts to be in the hold mode, the control device 25 turns on the lamp 70, so that the operator can recognize whether the working machine 1 is in the normal mode or in the hold mode. Thus, it is possible for the operator to recognize which mode the control device 25 is in.

In addition, the control device 25 changes the blinking speed of the lamp 70 in accordance with the speed of the hydraulic actuator of the auxiliary attachment 50. That is, the control device blinks the lamp 70 in accordance with the magnitude of the electric current outputted to the first solenoid valve 60A and the second solenoid valve 60B.

To explain more specifically, the blinking speed of the lamp 70 increases in proportion to the magnitude of the electric current outputted to the first solenoid valve 60A and the second solenoid valve 60B. In other words, the flow rate of the hydraulic fluid outputted from the auxiliary control valve 56C and the blinking speed of the lamp 70 are proportional to each other.

In other words, under the state where the control device 26 is shifted to be in the hold mode, the blinking speed of the lamp 70 is the fastest in the case where the held operation extent (the changed operation extent) of the operation member 24 is the maximum and the operation extent of the pedal 45A is the minimum in the hold mode. On the other hand, in the case where the operation extent of the operation member 24 is the minimum and the operation extent of the pedal 45A is the maximum, the blinking speed of the lamp 70 is the slowest.

In the configuration described above, the holding member 40 sets the held operation extent that is the operation extent at the time of operating the operation member 24. However, another configuration may be employed, where, when the holding member 40 is pressed, the control device 25 outputs a command to the first solenoid valve 60A and the second solenoid valve 60B on the basis of the preliminarily-set hold operation extent stored in the storage part 27 in advance.

In other words, the holding member 40 sets the held operation extent that is a preliminarily-set hold operation extent separately from the operation extent of the operation member 24. That is, in that configuration, when the holding member 40 is pressed, the hydraulic fluid of a preliminarily-set flow rate is supplied from the auxiliary control valve 56C to the hydraulic device 50.

To explain more specifically, when the holding member 40 is pressed, the control device 25 obtains a signal outputted from the holding member 40. Upon obtaining the signal, the control device 25 obtains the held operation extent previously stored in the storage part 27.

For example, the storage part 27 previously stores a held operation extent that is the same value as that of the case where the operation extent of the operation member 24 is the maximum. It should be noted that an external device may be connected to the control device 25 to change the setting, and thereby may change the held operation extent stored in the storage portion 27.

Similar to the above-described configuration, in the case where the control device 25 is in the hold mode, the control device 25 outputs a command to the first solenoid valve 60A and the second solenoid valve 60B, the command corresponding to the operation extent of the operation member 24 and/or the operation extent of the pedal 45A, on the basis of the held operation extent or the changed operation extent stored in advance in the storage portion 27.

For example, the control device 25 outputs a command with the electric current to the first solenoid valve 60A and the second solenoid valve 60B, the command corresponding to the held operation extent and the operation extent of the pedal 45A, on the basis of the held operation extent previously stored in the storage portion 27 and the operation extent of the pedal 45. On the other hand, when the holding member 40 is pressed again, the hold mode is canceled, the mode is shifted to the normal mode, and the flow rate of the hydraulic fluid to be outputted from the auxiliary control valve 56C is zero.

It should be noted that the storage part 27 may be configured not to store the held operation extent in advance, but may be configured to store in advance a program or the like for calculating the held operation extent. In that case, in the case where the control device 25 is in the hold mode, the control device 25 calculates the held operation extent with use of the program or the like stored in advance in the storage portion 27, and outputs a command to the solenoid valve 60A and the second solenoid valve 60B, the commend corresponding to the operation extent of the operation member 24 and/or the operation extent of the pedal 45A, on the basis of the held operation extent or the changed operation extent.

The hydraulic system for the working machine 1 mentioned above includes the first hydraulic pump P1, the hydraulic device 50, the operation member 24, and the control valve 56. In addition, the hydraulic system for the working machine 1 includes the holding member 40 and the pedal 45A. Moreover, the hydraulic system for the working machine 1 includes the control device 25.

Thus, the operation of the hydraulic device 50 can be kept constant by operating the holding member 40, and when the pedal 45A is operated by the foot, it is possible to easily change the operation of the hydraulic device 50. Thus, by operating the pedal 45A, the operator can easily change the working speed and the like of the working machine 1. In addition, since the operation extent before the change of the working speed of the holding member 40 can be held, it is possible to return to the working speed and the like before the changing.

In addition, the control device 25 controls the control valve 56 on the basis of the held operation extent changed by the pedal 45A, and thereby reduces the flow rate of the hydraulic fluid to be supplied to the hydraulic device 50. In this manner, by operating the pedal 45A different from the operation member 24, the operator can slow down the working speed and the like of the working machine 1.

Further, the hydraulic system of the working machine 1 is provided with the lamp 70. In this manner, the control device 25 turns on the lamp 70 when the working machine 1 shifts to be in the hold mode, so that the operator can recognize whether the working machine 1 is in the normal mode or in the hold mode. Thus, it is possible for the operator to recognize which mode the control device 25 is in.

Second Embodiment

Figure 4:
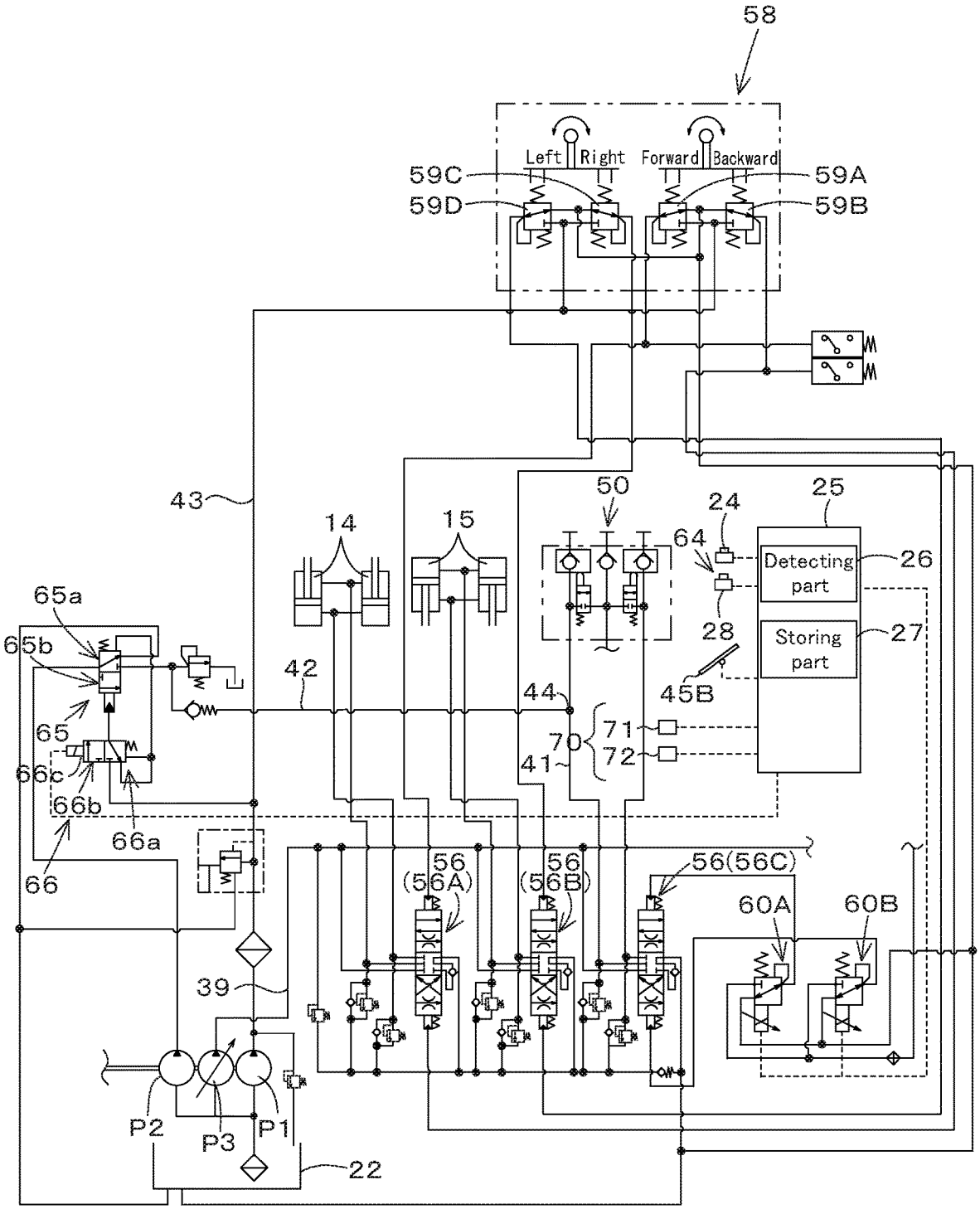
FIG. 4 is an overall view of a hydraulic system according to a second embodiment of the present invention.

FIG. 4 shows a hydraulic system according to a second embodiment of the present invention. In addition, the same reference numerals are given to the same components as those of the first embodiment, and the explanation thereof will be omitted.

The hydraulic system has a second hydraulic pump P2. The second hydraulic pump P2 is constituted of a pump configured to be driven by the power of the prime mover 32, and is constituted of a constant displacement type gear pump. The second hydraulic pump P2 is configured to output the operation fluid stored in the operation fluid tank 22.

In particular, the second hydraulic pump P2 outputs the operation fluid to be supplied to the hydraulic actuator of the auxiliary attachment 50 mainly in the high flow mode. The second hydraulic pump P2 and the first fluid tube 41 are connected to each other by the second fluid tube 42. That is, the operation fluid outputted from the second hydraulic pump P2 to the second fluid tube 42 is confluent with the first fluid tube 41.

The hydraulic system includes a switching valve (a high flow valve) 65 and a switching valve (a high flow switching valve) 66. The high flow valve 65 is a valve configured to set the flow rate of the hydraulic fluid flowing through the second fluid tube 42, and is constituted of a two-position switching valve configured to be operated by the pilot pressure.

The high flow valve 65 can be switched to two switching positions (the first position 65*a* and the second position 65*b*) by the pilot pressure. The high flow valve 65 is connected to an intermediate portion of the second fluid tube 42. That is, the high flow valve 65 is provided in the second fluid tube 42.

In the first position 65*a*, the high flow valve 65 sets the flow rate of the hydraulic fluid confluent with the first fluid tube 41 from the second fluid tube 42 to zero. In addition, the high flow valve 65 sets the flow rate of the hydraulic fluid flowing through the second fluid tube 42 from zero to a predetermined flow rate. In other words, the high flow valve 65 shuts off the second fluid tube 42 when the high flow valve 65 is at the first position 65*a*, and opens the second fluid tube 42 when the high flow valve 65 is at the second position 65*b*.

The high flow switching valve 66 is a valve configured to be switched to operate the high flow valve 65, and is constituted of an electromagnetic two-position high flow switching valve 66. The high flow switching valve 66 is configured to be switched between a first position 66*a* and a second position 66*b*.

The high flow switching valve 66 is connected to the output fluid tube 43. When the high flow switching valve 66 is in the first position 66*a*, the pilot pressure is not applied to the hydraulic receiving portion of the high flow valve 65, and the high flow valve 65 is set to the first position 65*a*.

When the high flow switching valve 66 is in the second position 66*b*, the pilot pressure is applied to the hydraulic receiving portion of the high flow valve 65, and the high flow valve 65 is set to the second position 65*b*.

The switching of the high flow switching valve 66 from the first position 66*a* to the second position 66*b* is performed by the switching member 64 connected to the control device 25. In addition, the switching member 64 can also operate the first solenoid valve 60A and the second solenoid valve 60B.

More specifically, the switching member 64 includes an operation member 24 configured to operate the first solenoid valve 60A and the second solenoid valve 60B and an operation member 28 configured to switch the high flow switching valve 66 from the first position 66*a* to the second position 66*b*. The operation member 24 has the same configuration as that of the above-described embodiment. The operation member 28 is constituted of a push switch configured to be pushed to be turned ON/OFF.

In the case where the operation member 24 is slid to the maximum position and the operation member 28 is pushed to be turned from OFF to ON, the control device 25 continuously magnetizes the solenoid 66*c* of the high flow switching valve 66. Then, the high flow switching valve 66 is held at the second position 66*b*. That is, by operating the switching member 64, the high flow valve 65 is held at the second position 65*b*.

According to the hydraulic system described above, when the high flow valve 65 is switched to the second position 65*b*, the hydraulic fluid outputted from the second hydraulic pump P2 passes through the high flow valve 65, and then the operation fluid flows to the connecting portion 44 that is an end portion of the second fluid tube 42. Then, the operation fluid flowing from the second fluid tube 42 and the operation fluid flowing through the first fluid tube 41 are confluent with each other at the connecting portion 44 and flow toward the auxiliary attachment 50, and thereby the operation fluid is increased.

On the other hand, when the high flow valve 65 is switched to the first position 65*a*, the hydraulic fluid outputted from the second hydraulic pump P2 is shut off by the high flow valve 65, and the operation fluid which cannot pass through the high flow valve 65 returns to the operation fluid tank 22. As the result, only the operation fluid flowing through the first fluid tube 41 flows toward the auxiliary attachment 50.

Meanwhile, when the pedal 45B is operated under the condition where the high flow valve 65 is held at the second position 65*b* by the switching member 64, the switching position of the high flow valve 65 is switched from the second position 65*b* to the first position 65*a*. That is, the embodiment is provided with a pedal 45B configured to switch the switching position of the high flow valve 65 from the second position 65*b* to the first position 65*a*.

The pedal 45B is an organ type operation pedal or a hanging type operation pedal arranged at the foot of the operator seat 8 of the working machine 1. That is, the pedal 45B is a member configured to be operated by a foot of the operator seated on the operator seat 8. The pedal 45B is a pedal member different from the accelerator pedal and the brake pedal. Meanwhile, the pedal 45B is not limited to the organ type operation pedal or the hanging type operation pedal, and may be anything as long as the pedal 45B is a pedal member configured to be operated by a foot of the operator.

In addition, in the case where the pedal 45B is operated under the state where the high flow valve 65 is held at the second position 65*b*, the control device 25 stops the magnetization of the high flow switching valve 66. That is, the high flow switching valve 66 is demagnetized.

Figure 5:
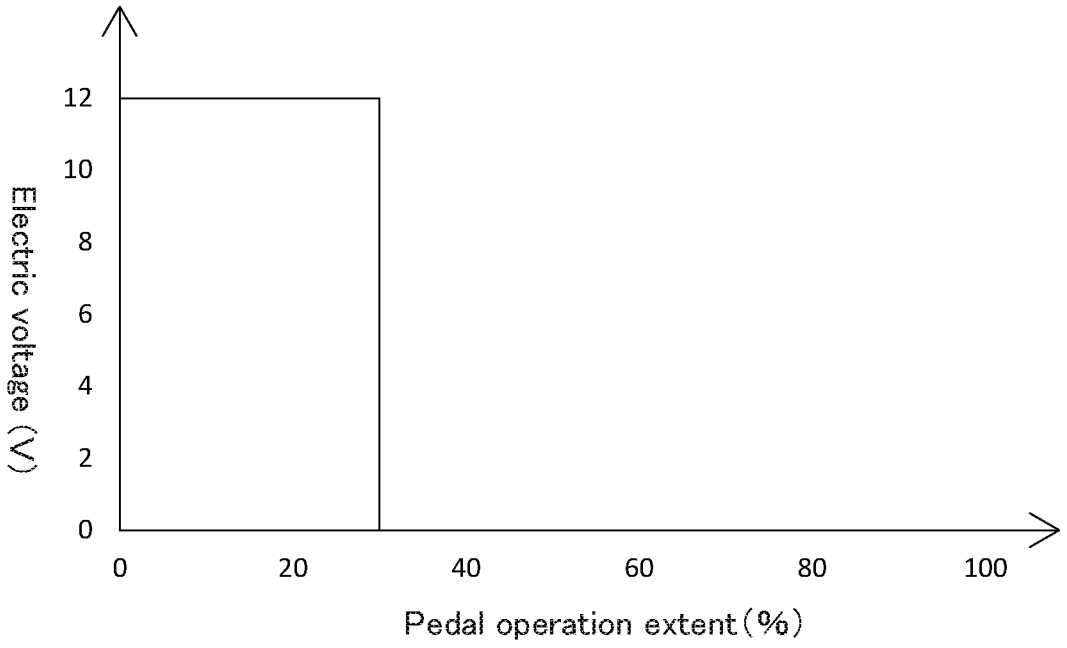
FIG. 5 is a view illustrating a relation between an operation extent of a pedal and an electric current outputted to a switching valve according to the second embodiment.

To specifically explain, as shown in FIG. 5, in the case where the operation extent of the pedal 45B is equal to or larger than the predetermined operation extent (30%), the magnitude of the electric current outputted to the high flow switch valve 66 by the control device 25 is zero. That is, in the case where the operation extent of the pedal 45B is larger than the predetermined extent, the control device 25 demagnetizes the high flow switching valve 66.

Then, the high flow valve 65 is switched to the first position 65*a*. On the other hand, in the case where the operation extent of the pedal 45B is smaller than the predetermined operation extent (30%), the control device 25 holds the magnetization of the high flow switching valve 66.

According to the above description, when the pedal 45B is operated in the high flow mode in which the flow rate of the hydraulic fluid supplied to the hydraulic actuator of the auxiliary attachment 50 is high, the flow rate of the operation fluid to be supplied to the hydraulic actuator can be reduced.

In this manner, the operator can release the high flow mode by operating the pedal 45B. Note that the threshold value of the operation extent of the pedal 45B is not limited to 30%, and may be 10%, 20%, or any rate, for example.

The lamp 70 includes a first lamp 71 and a second lamp 72. It is preferable that the first lamp 71 and the second lamp 72 are provided facing toward the operator side of the operation lever 58.

Meanwhile, the installation locations of the first lamp 71 and the second lamp 72 are not limited to the operation lever 58, and may be anywhere as long as the first lamp 71 and the second lamp 72 are arranged at a place that can be easily confirmed by an operator who is operating the working machine 1. The first lamp 71 and the second lamp 72 are connected to the control device 25, and the control device 25 controls the lighting of the first lamp 71 and the second lamp 72.

To explain more specifically, when the auxiliary control valve 56C is in the first position, the control device 25 turns on the first lamp 71. On the other hand, when the auxiliary control valve 56C is in the second position, the control device 25 turns on the second lamp 72.

In other words, the control device 25 outputs, to the first solenoid valve 60A and the second solenoid valve 60B, a command corresponding to the operation extent of the operation member 24 of the switching member 64. The first solenoid valve 60A and the second solenoid valve 60B are opened in accordance with the operation extent of the operation member 24 of the switching member 64.

As the result, the pilot fluid is supplied to the auxiliary control valve 56C connected to the first solenoid valve 60A and the second solenoid valve 60B, and the hydraulic actuator of the auxiliary attachment 50 is operated by the hydraulic fluid supplied from the auxiliary control valve 56C.

In addition, the control device 25 increases the blinking speed of the lamp 70 in the high flow mode. That is, the flashing speed of the lamp 70 is increased in accordance with the flow rate of the hydraulic fluid supplied to the hydraulic actuator of the auxiliary attachment 50.

To explain more specifically, in the case where the control device 25 is in the high flow mode, that is, in the case where the operation extent of the pedal 45 B is the minimum under a situation where the high flow valve 65 is held at the second position 65*b*, the flashing speed of the lamp 70 is the fastest.

On the other hand, in the case where the operation extent of the operation member 24 of the switching member 64 is the minimum or the operation extent of the pedal 45B is the maximum, the blinking speed of the lamp 70 is the slowest.

The hydraulic system for the working machine 1 as described above includes the first hydraulic pump P1, the second hydraulic pump P2, the first fluid tube 41, and the second fluid tube 42.

In addition, the hydraulic system for the working machine 1 is provided with a switching valve (a high flow valve) 64 having a first position 65*a* for blocking the operation fluid from flowing through the second fluid tube 42 and a second position 65*b* for allowing the operation fluid to flow through the second fluid tube 42, and with a switching member 64 configured to switch the switching valve 65 between the first position 65*a* and the second position 65*b*.

The pedal 45B is switched from the second position 65*b* to the first position 65*a* under a state in which the high flow valve 65 is held at the second position 65*b* by the operation of the switching member 64.

In addition, in the case where the operation of the pedal 45B is operated under the state where the high flow valve 65 is held at the second position 65*b* by the operation of the switching member 64, the control device 65 switches the high flow valve 65 from the second position 65*b* to the first position 65*a*.

In this manner, when the pedal 45B is operated in the high flow mode where the flow rate of the hydraulic fluid to be supplied to the hydraulic actuator of the auxiliary attachment 50 is high, the flow rate of the operation fluid to be supplied to the hydraulic actuator can be reduced. Thus, even in the high flow mode, the operator can easily cancel the high flow mode by operating the pedal 45B with the foot.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A hydraulic system for a working machine, comprising:

a first hydraulic pump to output an operation fluid;

a hydraulic device to be operated by the operation fluid;

an operation member to be manually operated for changing an operation extent;

a switch to switch between a first operation that holds the operation extent to a predetermined held operation extent and a second operation that does not hold the operation extent to the held operation extent;

a pedal to be operated for changing the held operation extent upon the first operation of the switch;

a control valve to control the hydraulic device based on the held operation extent when the switch is switched to the first operation and the held operation extent is not changed by the pedal, based on the held operation extent after being changed by the pedal when the switch is switched to the first operation and the held operation extent is changed by the pedal, and based on the operation extent when the switch is switched to the second operation.

2. The hydraulic system according to claim 1, further comprising:

a controller to control the control valve so that the control valve controls the hydraulic device based on the held operation extent after being changed by the pedal and thereby reduces a flow rate of the operation fluid that is supplied to the hydraulic device, when the switch is switched to the first operation and the held operation extent is changed by the pedal.

3. The hydraulic system according to claim 1, comprising a lamp to be lighted when the held operation extent is set.

4. A hydraulic system for a working machine comprising:
a first hydraulic pump to output an operation fluid;
a hydraulic device to be operated by the operation fluid;
an operation member to be manually operated for changing an operation extent;
a switch to switch between a first operation that holds the operation extent to a predetermined held operation extent and a second operation that does not hold the operation extent to the held operation extent;
a pedal to be operated, the pedal being other than the operation member;
a controller to change the held operation extent based on operation of the pedal; and
a control valve to control the hydraulic device
based on the held operation extent when the switch is switched to the first operation and the held operation extent is not changed by the pedal,
based on the held operation extent after being changed by the pedal when the switch is switched to the first operation and the held operation extent is changed by the pedal, and
based on the operation extent when the switch is switched to the second operation.

5. The hydraulic system according to claim 4,
wherein the controller controls the control valve so that the control valve controls the hydraulic device based on the held operation extent after being changed by the pedal and thereby reduces a flow rate of the operation fluid that is supplied to the hydraulic device, when the switch is switched to the first operation and the held operation extent is changed by the pedal.

6. The hydraulic system according to claim 5, comprising
a lamp to be lighted when the held operation extent is set.

7. The hydraulic system according to claim 4, comprising
a lamp to be lighted when the held operation extent is set.

8. A hydraulic system for a working machine comprising:
a first hydraulic pump to output an operation fluid;
a second hydraulic pump to output the operation fluid, the second hydraulic pump being other than the first hydraulic pump;
a hydraulic device to be operated by the operation fluid;
a first fluid tube connecting the hydraulic device to a control valve;
a second fluid tube connected to the second hydraulic pump and connected to the first fluid tube;
a switching valve arranged in the second fluid tube, the switching valve having a first position and a second position,
the first position blocking the operation fluid from flowing in the second fluid tube,
the second position allowing the operation fluid to flow in the second fluid tube;
a switching member to switch the switching valve between the first position and the second position; and
a pedal to switch the switching valve from the second position to the first position from a state in which the switching valve is held at the second position by operation of the switching member.

9. The hydraulic system according to claim 8,
wherein the switching valve is held at the second position when the switching member is operated.

10. A hydraulic system for a working machine comprising:
a first hydraulic pump to output an operation fluid;
a second hydraulic pump to output the operation fluid, the second hydraulic pump being other than the first hydraulic pump;
a hydraulic device to be operated by the operation fluid;
a first fluid tube connecting the hydraulic device to a control valve;
a second fluid tube connected to the second hydraulic pump and connected to the first fluid tube;
a switching valve arranged in the second fluid tube, the switching valve having a first position and a second position,
the first position blocking the operation fluid from flowing in the second fluid tube,
the second position allowing the operation fluid to flow in the second fluid tube;
a switching member to switch the switching valve between the first position and the second position; and
a pedal to be operated,
wherein a controller switches the switching valve from the second position to the first position when the pedal is operated under a state in which the switching valve is held at the second position by operation of the switching member.

11. The hydraulic system according to claim 10,
wherein the switching valve is held at the second position when the switching member is operated.

* * * * *